United States Patent [19]

McCullough

[11] 4,019,701

[45] Apr. 26, 1977

[54] TENSION CONTROL

[75] Inventor: Robert W. McCullough, Spartanburg, S.C.

[73] Assignee: Milliken Research Corporation, Spartanburg, S.C.

[22] Filed: Oct. 14, 1975

[21] Appl. No.: 621,858

Related U.S. Application Data

[60] Continuation of Ser. No. 507,510, Sept. 19, 1974, abandoned, which is a division of Ser. No. 403,174, Oct. 3, 1973, Pat. No. 3,905,210.

[52] U.S. Cl. ..... 242/152.1

[51] Int. Cl.[2] ..... B15H 59/10

[58] Field of Search ..... 242/152.1, 147, 149, 242/150, 155, 151, 131, 131.1

[56] References Cited

UNITED STATES PATENTS

| | | | |
|---|---|---|---|
| 1,024,800 | 4/1912 | McKean | 242/152.1 UX |
| 1,190,169 | 7/1916 | Holt | 242/152.1 UX |
| 1,562,112 | 11/1925 | Medeiros | 242/150 |
| 1,863,951 | 6/1932 | Swanson | 42/150 |
| 2,581,142 | 1/1952 | Rea | 242/150 X |

*Primary Examiner*—Stanley N. Gilreath
*Attorney, Agent, or Firm*—H. William Petry; Earle R. Marden

[57] ABSTRACT

Apparatus to adjustably support a yarn tension control between a knitting machine and the yarn creel which is supplying yarn to the knitting machine.

1 Claim, 3 Drawing Figures

TENSION CONTROL

This is a continuation of application Ser. No. 507,510, filed Sept. 19, 1974, now abandoned, which is a division of application Ser. No. 403,174, filed Oct. 3, 1973, now U.S. Pat. No. 3,905,210, granted Sept. 16, 1975.

The main object of this invention is to provide a new and efficient mounting bracket for a yarn guide and/or yarn tension control which can be vertically adjusted in very small increments of movement to provide the proper yarn take-off angle from the yarn supply package.

Other objects and advantages of the invention will become readily apparent as the specification proceeds to describe the invention with reference to the accompanying drawing, in which.

Figure 1:
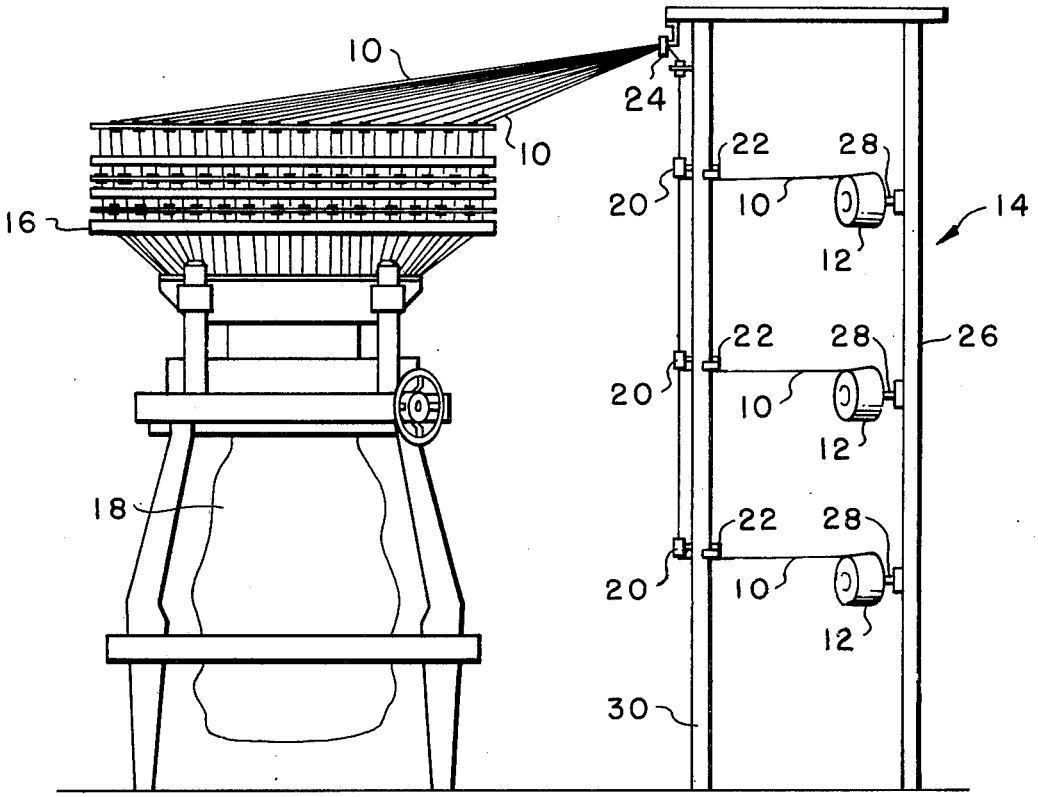
FIG. 1 is a schematic view of a yarn creel supplying yarn to a knitting machine.

Looking now to FIG. 1, a typical knitting machine arrangement is shown wherein a plurality of yarns 10 supplied from packages 12 is supplied from an off-side creel 14 to the circular knitting machine 16 whereat the yarn is knit into a fabric 18. The yarn 10 from the packages 12 to the knitting machine 18 passes successively through the tension control 20, mounted on the support bracket 22, and the stop motion 24 to stop the knitting machine 18 in case of a yarn break.

Figure 2:
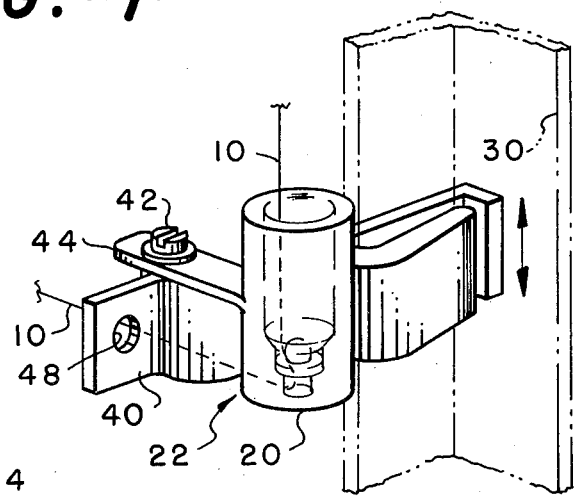
FIG. 2 is a perspective view of the new and improved yarn tension control mounted in operating position.
Figure 3:
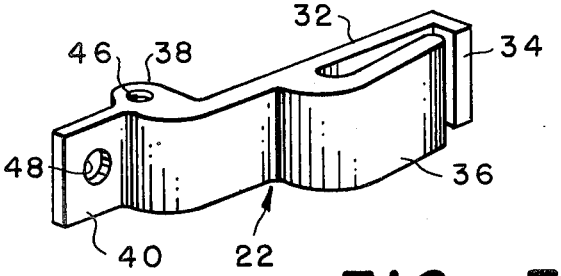
FIG. 3 is a perspective view of the new support bracket per se.

The creel 14 has a plurality of vertical bars 26 at the rear which have a plurality of projections 28 connected thereto to support the yarn packages 12 and a plurality of vertical angle iron supports 30 at the front to which are slidably mounted to the support bracket 22. The tension control member 20 can be of any commercially available type such as shown in FIG. 2 and described in U.S. Pat. No. 3,753,535. The vertical bars tend to collect substantially less lint than the previously used horizontal bars.

The support bracket 22 is preferably a one piece molded cast or fabricated member which has an elongated body portion 32, a stop portion 34 substantially perpendicular to the body portion 32 at one end thereof, a lip portion 36 connected to the body portion and projecting toward the stop portion 34, a thickened portion 38 at the other end of the body portion 32 to support the tension control member 20 and a projection 40 projecting outwardly from the thickened portion 38 for reasons hereinafter explained.

The support member 22 is slidably mounted on the angle member 30 with the stop portion 34 engaging the outside of the angle iron member 30 and the lip portion 36 engaging the inside of angle member 30. The tension control 20 is connected to the thickened portion 38 by suitable means, such as screw 42, which engages the mounting means 44 of the tension control 20 and passes into the opening 46 of the support member 22. The support member 22 can be slid upwardly or downwardly on the angle iron member 30 to correctly position it in relation to the yarn package to obtain optimum running conditions.

If it is desired to eliminate the use of the tension control 20, a ceramic guide member (not shown) can be inserted in the opening 48 of the projection 40 and the yarn can be run directly into the guide member in the opening 48 and upwardly to the stop motion 24 and then the knitting machine.

It can be seen that I have provided a simple compact yarn support and/or guide member which can be readily made and can be easily adjusted for changing yarn conditions.

Although I have described in detail the preferred embodiments of my invention, I contemplate that many changes may be made without departing from the scope or spirit of my invention, and I desire to be limited only by the scope of the claims.

That which is claimed is:

1. Yarn tension control apparatus comprising: an elongated body member, a flange portion connected to said body member and extending outwardly and substantially perpendicular to said body member, a lip portion connected to said body member extending towards and closely adjacent said flange member to form an elongated narrow space between said body member and said lip portion to provide a space to slidably accommodate a structural member to which said apparatus is to be attached, said body member having an enlarged portion thereof spaced from said flange member and extending outwardly from said body portion in a direction opposite to said flange portion, a yarn tension control means connected to said enlarged portion and a second flange member connected to and extending outwardly from said enlarged portion to support a yarn guide member.

* * * * *